US011355265B2

(12) United States Patent
Moriyama et al.

(10) Patent No.: US 11,355,265 B2
(45) Date of Patent: Jun. 7, 2022

(54) CABLE

(71) Applicant: Hitachi Metals, Ltd., Tokyo (JP)

(72) Inventors: Masashi Moriyama, Tokyo (JP); Detian Huang, Tokyo (JP); Yoshinori Tsukamoto, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 17/229,059

(22) Filed: Apr. 13, 2021

(65) Prior Publication Data

US 2022/0084719 A1 Mar. 17, 2022

(30) Foreign Application Priority Data

Sep. 15, 2020 (JP) ..... JP2020-154657

(51) Int. Cl.

| | |
|---|---|
| ***H01B 7/22*** | (2006.01) |
| ***H01B 7/04*** | (2006.01) |
| ***H01B 11/10*** | (2006.01) |

(52) U.S. Cl.

CPC ..... *H01B 7/228* (2013.01); *H01B 7/04* (2013.01); *H01B 11/1033* (2013.01)

(58) Field of Classification Search

CPC ..... H01B 11/1033; H01B 7/04; H01B 7/228; H01B 7/1865

See application file for complete search history.

(56) References Cited

U.S. PATENT DOCUMENTS

| | | | | |
|---|---|---|---|---|
| 3,870,987 A * | 3/1975 | Wiley | H01B 3/445 338/214 |
| 5,057,812 A * | 10/1991 | Yukawa | H01B 7/0063 338/66 |
| 7,989,700 B2 | 8/2011 | Eshima | |
| 2010/0116541 A1* | 5/2010 | Eshima | H01B 7/1865 174/388 |

FOREIGN PATENT DOCUMENTS

| | | |
|---|---|---|
| JP | 2010-114019 A | 5/2010 |
| JP | 2015-079574 A | 4/2015 |
| JP | 2018-110075 A | 7/2018 |
| JP | 6610819 B1 | 11/2019 |
| JP | 2020155224 A * | 9/2020 |

OTHER PUBLICATIONS

Japanese Office Action, dated Nov. 10, 2020, in Japanese Application No. 2020-154657 and English Translation thereof.
Japanese Office Action, dated Apr. 12, 2021, in Japanese Application No. 2020-154657 and English Translation thereof.

* cited by examiner

*Primary Examiner* — Hoa C Nguyen
*Assistant Examiner* — Amol H Patel
(74) *Attorney, Agent, or Firm* — McGinn I.P. Law Group, PLLC.

(57) ABSTRACT

A cable is composed of a cable core including one or more electric wires, a braided shield covering a periphery of the cable core and including braided metal wires, a sheath covering a periphery of the braided shield, and a cushion layer provided between the cable core and the braided shield. The cushion layer is composed of a braid including braided linear shape fiber yarns.

16 Claims, 3 Drawing Sheets

CABLE

CROSS-REFERENCE TO RELATED APPLICATION

The present application is based on Japanese patent application No. 2020-154657 filed on Sep. 15, 2020, the entire contents of which are incorporated herein by reference.

BACKGROUND OF THE INVENTION

1. Field of the Invention

The present invention relates to a cable.

2. Description of the Related Art

In order to enhance productivity in a factory or the like, the widespread use of industrial robots such as cooperative robots or small articulated robots or the like is expanding. As an example of a cable being used to be wired to a movable part (a part to be subjected to bending or torsion) of such an industrial robot, there is a cable having a braided shield composed of a plurality of metal wires braided together, and a sheath, which in turn have been provided over a periphery of a cable core composed of a plurality of electrical insulated wires stranded together. (See, e.g., JP2015-79574A below.)

[Patent Document 1] JP2015-79574A

SUMMARY OF THE INVENTION

In the above mentioned conventional cable wired to the movable part of the industrial robot and the like, however, there has been a problem with a disordered state being caused in the plurality of metal wires of the braided shield by repeated bending of the same cable resulting from the movements of the movable part of the industrial robot and the like, and a subsequent wire break being caused in the plurality of metal wires of the braided shield by more repeated bending of the same cable. The occurrence of the wire break in the plurality of metal wires of the braided shield leads to a degradation in the function of the braided shield acting as a shielding layer.

In light of the foregoing, it is an object of the present invention to provide a cable which is designed to be resistant to the occurrence of a wire break in a plurality of metal wires together constituting a braided shield, when repeatedly bent.

For the purpose of solving the aforementioned problem, the present invention provides a cable, comprising:

- a cable core including one or more electric wires;
- a braided shield covering a periphery of the cable core and including braided metal wires;
- a sheath covering a periphery of the braided shield; and
- a cushion layer provided between the cable core and the braided shield, the cushion layer comprising a braid including braided linear shape fiber yarns.

Points of the Invention

According to the present invention, it is possible to provide the cable which is designed to be resistant to the occurrence of a wire break in a plurality of the metal wires together constituting the braided shield, when repeatedly bent.

BRIEF DESCRIPTION OF THE DRAWINGS

Next, preferred embodiment according to the present invention will be described with reference to appended drawings, wherein.

DETAILED DESCRIPTION OF THE PREFERRED EMBODIMENTS

Embodiment

An embodiment of the present invention will be described below in conjunction with the accompanying drawings.

Figure 1:
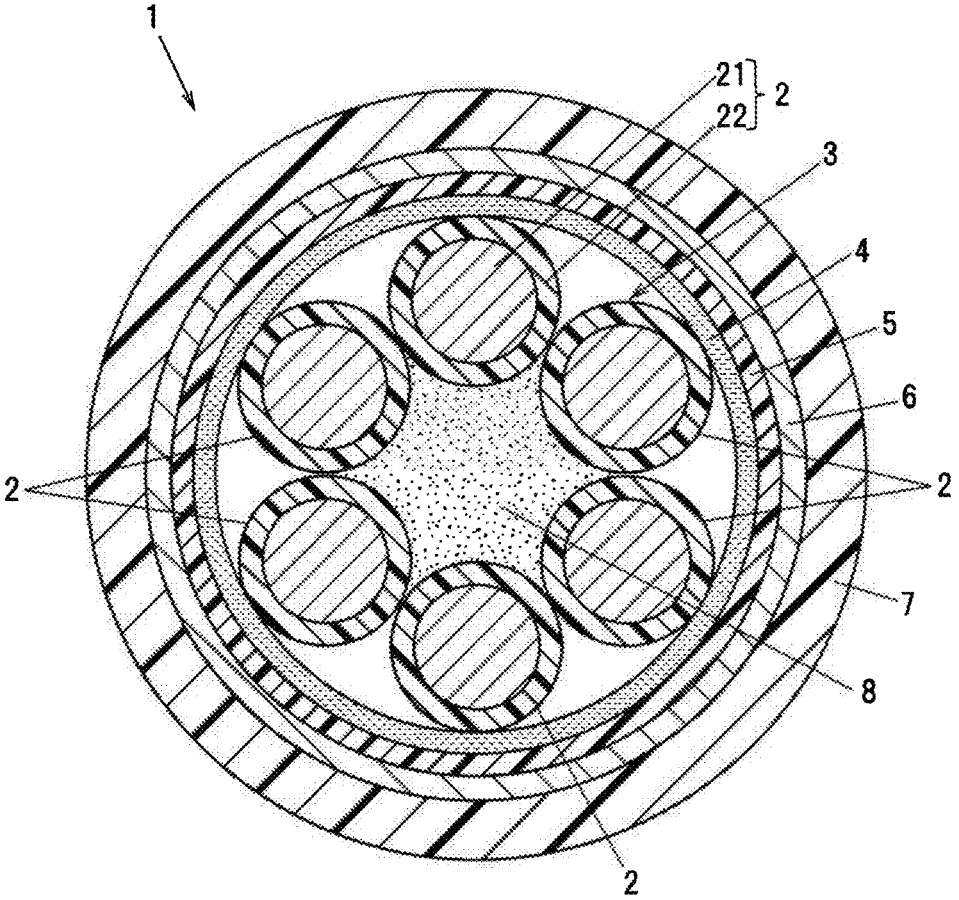
FIG. 1 is a cross-sectional view showing a cross section perpendicular to a longitudinal direction of a cable according to one embodiment of the present invention.

FIG. 1 is a cross-sectional view showing a cross section perpendicular to a longitudinal direction of a cable 1 according to the present embodiment. The cable 1 shown in FIG. 1 is, for example, the cable designed to be wired in such a manner as to stride over a movable part or a swingable part of an industrial robot or the like, and is the one designed to be used in applications for repeated bending (especially, in a place to be subjected to repeated sliding movements in a state of being bent in a U-shape).

The cable 1 is configured in such a manner as to include a cable core 3 having one or more electric wires 2, a braided shield 6, which is covering a periphery of the cable core 3 and including braided metal wires, and a sheath 7, which is covering a periphery of the braided shield 6. In the cable 1 according to the present embodiment, a cushion layer (also referred to as wire break suppressing layer) 5, which is configured to suppress the occurrence of a wire break in the metal wires together constituting the braided shield 6 when the cable 1 is repeatedly bent, is provided between the cable core 3 and the braided shield 6. The detail of the cushion layer 5 will be described later.

The one or more electric wires 2 together constituting the cable core 3 each of which has a conductor 21, and an electrical insulating member 22, which is covering a periphery of the conductor 21. Each of the constituent conductors 21 of the one or more electric wires 2 is composed of a stranded wire conductor produced by stranding together metal wires each made of a tin-plated annealed copper wire or the like. Each of the constituent conductors 21 of the one or more electric wires 2 may be configured with a composite stranded wire produced by using child stranded wires each composed of metal wires stranded together and further stranding a plurality of the child stranded wires together. For the constituent electrical insulating members 22 of the one or more electric wires 2, it is possible to use, e.g., an electrical insulating material made of polyethylene or fluoropolymer resin.

In the present embodiment, the cable core 3 is configured by providing a fibrous filling member 8 composed of rayon yarns (staple fiber yarns) or the like over a center of the cable 1, and stranding a plurality (herein six) of the electric wires 2 together on a periphery of that filling member 8. It should be noted, however, that the configuration of the cable core 3 is not limited to the foregoing, but that the cable core 3 may be configured in such a manner that in place of the fibrous filling member 8, e.g., a linear shape body, a tension member, or the like made of a resin or the like may be provided over the center of the cable 1. Further, the number of electric wires 2 together constituting the cable core 3 is also not limited to the one shown in FIG. 1, but the cable core 3 may be configured with one electric wire 2, for example. In this case, the cable 1 is configured as a coaxial cable.

A binder tape 4 is helically wrapped around a periphery of the cable core 3. The binder tape 4 acts to hold the strands of the cable core 3 so that the strands of the cable core 3 are not unlaid. For the binder tape 4, it is possible to use, e.g., a tape made of a paper or a nonwoven fabric cloth or the like, or a resin tape made of PE (polyethylene) or the like. Although the details will be described later, because it has been able to be confirmed that when the cable 1 has repeatedly been bent, the occurrence of a disordered state in the metal wires of the braided shield 6 has been able to be suppressed by using the resin tape rather than by using the nonwoven fabric cloth tape, the resin tape may more preferably be used as the binder tape 4. Note that the binder tape 4 is not indispensable, but that it is substitutable by e.g., a thread-like body made of a resin or a cotton or the like being wrapped around the periphery of the cable core 3.

The braided shield 6 acts as a shielding layer to provide a shield against noise coming from outside, and is covering the periphery of the cable core 3. For the cable 1, configuring its shielding layer with the braided shield 6 enables the flexibility of the cable 1 to be enhanced. In the present embodiment, the cushion layer 5 is provided on a periphery of the binder tape 4, and the braided shield 6 is provided on a periphery of the cushion layer 5. Although herein the braided shield 6 constituted by the metal wires braided together is used, the configuration of the braided shield 6 is not limited to the foregoing, but for the braided shield 6, it is also possible to use, for example, a mixed woven braided shield which is produced by weaving metal wires and constituent resin wires made of a resin, such as rayon yarns (staple fiber yarns) or the like, together into a braid. Further, for the metal wires using the braided shield 6, it is also possible to use, for example, a metal wire coated with a lubricating material such as a liquid paraffin or the like. This makes it possible to further suppress the occurrence of an abrasion together of the braided shield 6 and the cushion layer 5. Note that the braid density of the braided shield 6 may be set at not lower than 85 percent, from the point of view of providing a shield against noise coming from outside. For the metal wires together constituting the braided shield 6, it is possible to use, e.g., a tin-plated annealed copper wire.

The sheath 7 is provided over a periphery of the braided shield 6, and acts to protect the braided shield 6 and the cable core 3. The sheath 7 may be configured in such a manner as to be made of, e.g., polyvinyl chloride resin, urethane resin, fluoropolymer resin, fluorine rubber, or the like, or may be configured as the one made of a resin composition containing at least one of these types of resins as a main component (base polymer).

(Cushion Layer 5)

The cushion layer 5 is provided between the cable core 3 and the braided shield 6 (more specifically, between the binder tape 4 and the braided shield 6), and when the cable 1 is bent (especially, when the cable 1 is subjected to repeated sliding movements in a state of being bent in a U-shape), the cushion layer 5 acts to mitigate a lateral pressure applied to the braided shield 6 by the cable core 3 in the bent portion of the cable 1. By allowing the cushion layer 5 to mitigate the lateral pressure applied by the cable core 3 to the braided shield 6, when the cable 1 is repeatedly bent (especially when the cable 1 is subjected to repeated sliding movements in a state of being bent in a U-shape), it is possible to suppress the occurrence of a disordered state in the braid of the metal wires together constituting the braided shield 6, and therefore the metal wires of the braided shield 6 become resistant to abrading each other and, as a result, it is possible to prevent the wire break in the metal wires of the braided shield 6 from being caused by the abrasion together of the metal wires of the braided shield 6. Note that the thickness of the cushion layer 5 may be set at such a thickness as to be able to mitigate the lateral pressure applied from the cable core 3 to the braided shield 6 when the cable 1 is bent, and thereby suppress the occurrence of a wire break in the metal wires together constituting the braided shield 6.

It is also conceivable that the cable 1 is configured in such a manner that, for example, a tape material, which is high in cushioning performance, is used for the binder tape 4 so that the binder tape 4 is used as a substitute for the cushion layer 5 (that is, it is conceivable that the cable 1 is configured in such a manner that the binder tape 4 and the braided shield 6 are brought into contact with each other with no cushion layer 5 being provided between the binder tape 4 and the braided shield 6), but in this case, since the tape material for the binder tape 4 is resistant to following the movement of the braided shield 6, the tape material for the binder tape 4 and the braided shield 6 are rubbed against each other when the cable 1 is repeatedly bent. Further, at this point of time, the occurrence of such a rubbing together of the tape material for the binder tape 4 and the braided shield 6 in an uneven portion of the tape material for the binder tape 4 causes a disordered state in the metal wires of the braided shield 6, which leads to concern that a wire break may occur in the metal wires of the braided shield 6.

Further, it is also conceivable that the cable 1 is configured in such a manner that, for example fiber yarns such as rayon yarns (staple fiber yarns) or the like are wound laterally (wrapped side by side) around the periphery of the binder tape 4 by being helically wound therearound, so that the laterally wound fiber yarns together constitute the cushion layer 5. In this case, however, a misalignment or an overlapping between the side by side fiber yarns together constituting the cushion layer 5 occurs when the cable 1 is repeatedly bent, accompanied by a collapsing in the shape of the cushion layer 5, which leads to concern that the cushioning function of the cushion layer 5 may not be fulfilled.

For the purpose of avoiding the foregoing problems, in the present embodiment, the cushion layer 5 is configured with a braided layer, which is constituted by linear shape fiber yarns braided together. By the cushion layer 5 being configured with the above braided layer constituted by linear shape fiber yarns braided together, when the cable 1 is repeatedly bent, the above configuration of the cushion layer 5 allows the cushion layer 5 to easily follow the movement of the braided shield 6, and the rubbing (sliding) of the braided shield 6 and the cushion layer 5 relative to each other to be minimized and, as a result, it is possible to suppress the occurrence of an abrasion together of the metal wires of the braided shield 6. In the present embodiment, rayon yarns (staple fiber yarns) are used as the fiber yarns together constituting the cushion layer 5. It should be noted, however, that the fiber yarns together constituting the cushion layer 5 are not limited to the foregoing rayon yarns (staple fiber yarns), but that the fiber yarns together constituting the cushion layer 5 may be configured as the ones made of a material designed to suppress the occurrence of a wire break in the metal wires together constituting the braided shield 6, and that for the fiber yarns together constituting the cushion layer 5, it is also possible to use, for example, a nylon yarn or a cotton yarn or the like.

When the rayon yarns (staple fiber yarns) are used as the fiber yarns together constituting the cushion layer 5, the rayon yarns (staple fiber yarns) may be composed of the following type: single yarns or two-ply yarns with a yarn count of from 10 to 60. Preferably, for the rayon yarns (staple fiber yarns), the two-ply yarns with a yarn count of 10, 20, 40, or 60, or the single yarns with a yarn count of 10, or 20 may be used. Further, from the point of view of suppressing the occurrence of a wire break in the fiber yarns together constituting the cushion layer 5, the fiber yarns are configured to preferably have a tensile strength of not lower than 2.5 N and an elongation of not lower than 10 percent. The tensile strengths and the elongations of the fiber yarns can be obtained by using a testing method in compliance with Section 9.5.1 of JIS L 1095 (2010).

Note that the cable 1 may be configured to allow the cushion layer 5 not to completely follow the movement of the braided shield 6 when the cable 1 is repeatedly bent, but that the cable 1 may be configured to allow a slight sliding of the cushion layer 5 and the braided shield 6 relative to each other to occur. For example, if the fiber yarns together constituting the cushion layer 5 and the metal wires together constituting the braided shield 6 are stuck together to cause a disruption to the sliding of the braided shield 6 relative to the cushion layer 5, then a load is applied to the constituent fiber yarns of the cushion layer 5 and the metal wires of the braided shield 6, which leads to concern that a failure such as a wire break or the like in the metal wires of the braided shield 6 may occur. For the purpose of avoiding the foregoing problem, in the present embodiment, the cable 1 may be configured in such a manner that an angle formed by the fiber yarns in the cushion layer 5 with respect to the longitudinal direction of the cable 1 is made smaller than an angle formed by the metal wires of the braided shield 6 with respect to the longitudinal direction of the cable 1. This makes the metal wires of the braided shield 6 resistant to being stuck in the constituent fiber yarns of the cushion layer 5 and, as a result, the sliding of the braided shield 6 relative to the cushion layer 5 is enhanced. The angle formed by the fiber yarns in the cushion layer 5 with respect to the longitudinal direction of the cable 1 is set at, for example, not smaller than 15 degrees and not greater than 30 degrees. In addition, the angle formed by the metal wires in the braided shield 6 with respect to the longitudinal direction of the cable 1 is set at, for example, not smaller than 35 degrees and not greater than 60 degrees.

Further, if the braided constituent fiber yarns of the cushion layer 5 are too low in their braid density, their stitch length is long, which leads to concern that the metal wires of the braided shield 6 may easily get stuck in the constituent fiber yarns of the cushion layer 5. For that reason, the braid density of the cushion layer 5 is preferably set at not lower than 85 percent. By setting the braid density of the cushion layer 5 at not lower than 85 percent, the irregularities on the surface of the cushion layer 5 are reduced to a substantially smoothed surface state and, as a result, it is possible to further enhance the sliding of the braided shield 6 relative to the cushion layer 5. In particular, it is preferable that the braid density of the cushion layer 5 is made higher than the braid density of the braided shield 6. More specifically, the braid density of the cushion layer 5 may be made higher than the braid density of the braided shield 6, in a range of the braid density of the braided shield 6 of not lower than 85 percent and in a range of the braid density of the cushion layer 5 of not lower than 90 percent.

Note that in the present embodiment, the cable 1 is configured in such a manner that the cushion layer 5 and the braided shield 6 are in direct contact with each other, but that the cable 1 may be configured in such a manner that a separate member is interposed between the cushion layer 5 and the braided shield 6. For example, the cable 1 may be configured in such a manner that a tape member such as a resin tape or the like is wrapped around the periphery of the cushion layer 5, followed by the braided shield 6 being provided on a periphery of that tape member.

(Bending Test)

The cables 1 in Examples 1, 2, and 3 were prototyped, and a U-shape bending test was conducted thereon. In the cable 1 of Example 1, the binder tape 4 was configured with a nonwoven fabric cloth tape, while in the cable 1 of Example 2, the binder tape 4 was configured with a resin tape made of PE (polyethylene). Also, the cable 1 of Example 3 was configured by omitting the binder tape 4 and wrapping a thread-like body around the periphery of the cable core 3 instead, and was configured by wrapping a resin tape made of PE (polyethylene) around the periphery of the cushion layer 5, followed by providing the braided shield 6 on the periphery of that resin tape. In each of Examples 1, 2, and 3, a P/Pd ratio, which referred to a ratio of a twist pitch P of the cable core 3 to a diameter Pd of a circle passing through centers of the respective six constituent electric wires 2 of the cable core 3, was set at 12. Further, in each of Examples 1, 2, and 3, the angle of the respective metal wires in the braided shield 6 with respect to the longitudinal direction of the cable 1 was set at 50 degrees, while the angle formed by the respective constituent fiber yarns in the cushion layer 5 with respect to the longitudinal direction of the cable 1 was made smaller than 50 degrees. Further, in each of Examples 1, 2, and 3, the braid density of the cushion layer 5 was set at not lower than 90 percent, while the braid density of the braided shield 6 was set at not lower than 85 percent, and the braid density of the cushion layer 5 was made higher than the braid density of the braided shield 6.

Figure 2:
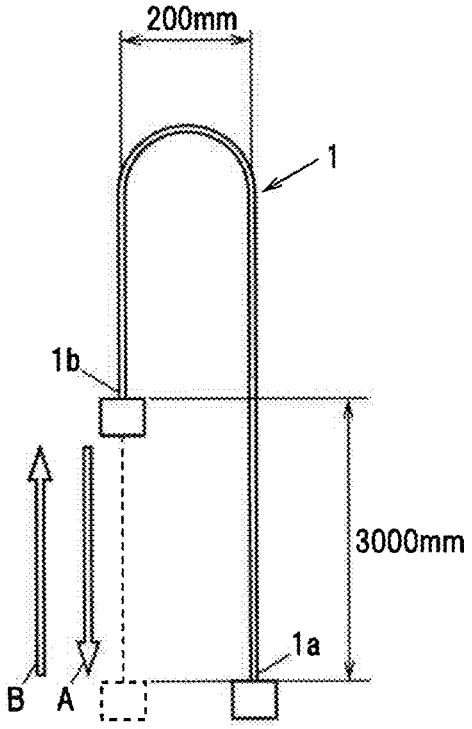
FIG. 2 is an explanatory diagram showing a U shape bending test.

In the U-shape bending test, as shown in FIG. 2, one end 1*a* of the cable 1 was fixed, while at the same time the cable 1 was bent in a U-shape in such a manner that its bending radius was set at 200 mm, and the other end 1*b* of the cable 1 was slid along the longitudinal direction thereof. A stroke width in the sliding of the other end 1*b* of the cable 1 was set at 3000 mm, and one sliding cycle (one time sliding) was defined as moving the other end 1*b* of the cable 1 in a pulling direction (in FIG. 2, indicated by an arrow A direction), and subsequently moving the other end 1*b* of the cable 1 in a pushing direction (in FIG. 2, indicated by an arrow B direction). A testing speed was set at 2600 mm/s, and the time taken for one stroke was set at about 3 seconds. Further, in the U-shape bending test, a voltage of several volts was constantly being applied to the cable 1, and a time at which an electric current value was lowered by 20 percent as compared to its value at a time of start of the test was regarded as a time of occurrence of a rupture in the cable 1.

Figure 3A:
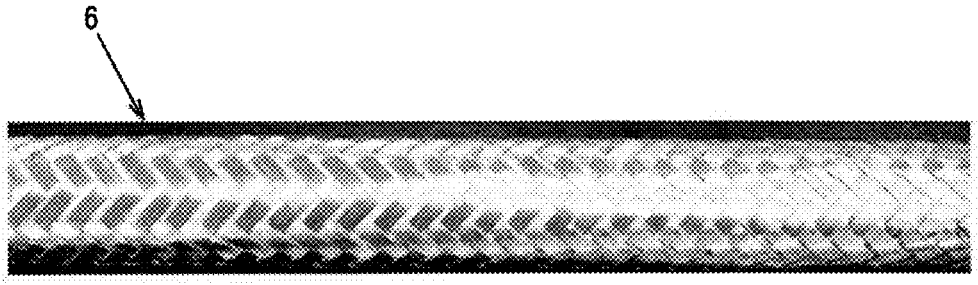
FIG. 3A is a photograph showing an appearance of a braided shield after having been bent 27000 times in Example 2.

As a result of the U-shape bending test, in the cables 1 in Examples 1, 2, and 3, no rupture occurred, even when the cables 1 in Examples 1, 2, and 3 were subjected to 27000 times repeated bending. Further, as a result of observing the states of the respective braided shields 6 of the cables 1 in Examples 1, 2, and 3 after having been subjected to the 27000 times repeated bending, it was confirmed that substantially no disordered state was being caused in the braids of the metal wires together constituting the respective braided shields 6 (the disordered states in the metal wires of the respective braided shields 6 were negligible), and that no wire break (rupture) in the metal wires of the respective braided shields 6 due to the disordered states therein was being caused as well. Further, as a result of the U-shape bending test, it was confirmed that among the cables 1 in Examples 1, 2, and 3, the cable 1 in Example 2 using the resin tape made of the PE (polyethylene) as the binder tape 4 was in the most negligible disordered state in the braid of the metal wires together constituting the braided shield 6. In FIG. 3A was shown a photograph of this cable 1 of Example 2 after having been subjected to the 27000 times repeated bending. As shown in FIG. 3A, in the cable 1 of Example 2, substantially no disordered state was being caused in the braid of the metal wires of the braided shield 6 even after that cable 1 having been subjected to the 27000 times repeated bending.

Figure 3B:
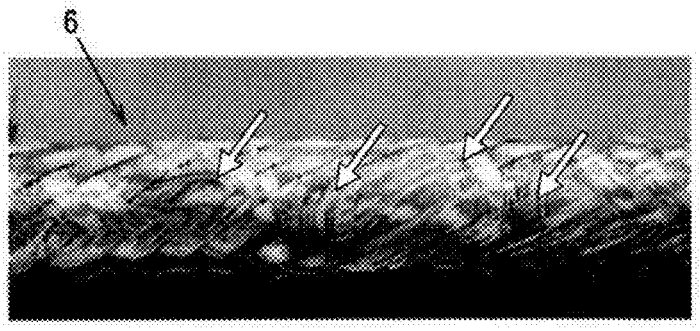
FIG. 3B is a photograph showing an appearance of a braided shield after having been bent 3000 times in a comparative example.

Also, a cable of a comparative example was made that was the same in configuration as the cable 1 of Example 1 except that the cushion layer 5 was omitted, and the U-shape bending test was conducted in the same manner as in Examples 1, 2, and 3. As a result of that U-shape bending test, in the cable of the comparative example, a rupture occurred at a stage at which that cable was subjected to about 3000 times repeated bending. In FIG. 3B was shown a photograph of the cable of the comparative example after having been subjected to the about 3000 times repeated bending. As shown in FIG. 3B, in the cable of the comparative example in which the cushion layer 5 was omitted, it was confirmed that greatly disordered states (in FIG. 3B, parts indicated by white outlined arrows) were being caused in the braid of the metal wires of the braided shield 6. From the above, it was able to be confirmed that by the cushion layer 5 being provided between the cable core 3 and the braided shield 6 (more specifically, between the binder tape 4 and the braided shield 6), a bending life of not shorter than 9 times was achieved, as compared with the case where no cushion layer 5 was being provided therebetween. This was considered to be because the cushion layer 5 formed by braiding the constituent fiber yarns together performed the function of mitigating the stress (the lateral pressure from the cable core 3) applied to the braided shield 6 when the cable 1 was bent.

Note that in Example 3, the resin tape was being provided between the cushion layer 5 and the braided shield 6, but that the cable 1 of Example 3 achieved the U shape bending test result analogous to those of Examples 1 and 2 which were not being provided with that resin tape between the cushion layer 5 and the braided shield 6. That is, it was able to be said that even when the resin tape was being interposed between the cushion layer 5 and the braided shield 6, the cushion layer 5 was mitigating the lateral pressure applied by the cable core 3 to the braided shield 6 when the cable 1 was bent. It was able to be said that from the point of view of cost reduction by reducing the number of parts, it was desirable to omit the resin tape between the cushion layer 5 and the braided shield 6, and that it was more desirable that the cushion layer 5 and the braided shield 6 were in direct contact with each other.

(Actions and Advantageous Effects of the Embodiment)

As described above, the cable 1 according to the present embodiment is configured in such a manner as to include therein the cushion layer 5 provided between the cable core 3 and the braided shield 6, and the cushion layer 5 is composed of a braid including braided the constituent linear shape fiber yarns together.

The cushion layer 5 is moved in such a manner as to be interlocked with (in such a manner as to follow) the braided shield 6 when the cable 1 is bent, and acts to mitigate the stress (the lateral pressure) applied from the cable core 3 to the metal wires of the braided shield 6 when the cable 1 was bent. Thus, when the cable 1 is repeatedly bent, the cushion layer 5 is able to suppress the occurrence of a disordered state in the braid of the metal wires of the braided shield 6 and, as a result, it is possible to achieve the cable 1, which is resistant to the occurrence of a wire break in a plurality of the metal wires together constituting the braided shield 6, even when the cable 1 was bent. That is, according to the present embodiment, it is possible to achieve the cable 1 designed for a movable part, which is high in bending resistance, and which is greatly enhanced in lifetime.

Further, by the cushion layer 5 being provided between the cable core 3 (the one or more electric wires 2) and the braided shield 6 (more specifically, between the binder tape 4 and the braided shield 6), the cushion layer 5 is able to protect the cable core 3 from being damaged by the braided shield 6. If the cushion layer 5 is not provided between the cable core 3 (the one or more electric wires 2) and the braided shield 6 (more specifically, between the binder tape 4 and the braided shield 6), then there is concern that during the repeated bending of the cable 1, the binder tape 4 and the respective constituent electrical insulating members 22 of the one or more electric wires 2 may be abraded due to the abrasion together of the binder tape 4 and the braided shield 6, and the abrasion together of the respective constituent electrical insulating members 22 of the one or more electric wires 2 and the braided shield 6, but by the cushion layer 5 being provided between the cable core 3 (the one or more electric wires 2) and the braided shield 6 (more specifically, between the binder tape 4 and the braided shield 6), the cushion layer 5 is also able to suppress the occurrence of the above failures.

Note that in the case where the cable core 3 is configured by stranding a plurality of the electric wires 2 together, the load applied to the braided shield 6 by the cable core 3 is considered to become large due to the influence of the irregularities on the surface of the cable core 3, as compared with the case where the cable core 3 is configured with one electric wire 2. The present invention is especially effective in the above case, that is, in the case where the cable core 3 is configured by stranding a plurality of the electric wires 2 together.

Summary of the Embodiments

Next, the technical ideas grasped from the aforementioned embodiments will be described with the aid of the reference characters and the like in the embodiments. It should be noted, however, that each of the reference characters and the like in the following descriptions is not to be construed as limiting the constituent elements in the appended claims to the members and the like specifically shown in the embodiments.

[1] A cable (1), comprising: a cable core (3) including one or more electric wires (2); a braided shield (6) covering a periphery of the cable core (3) and including braided metal wires (2); a sheath (7) covering a periphery of the braided shield (6); and a cushion layer (5) provided between the cable core (3) and the braided shield (6), the cushion layer (5) comprising a braid including braided linear shape fiber yarns.

[2] The cable (1) as defined in the above [1], wherein the cable core (3) comprises a plurality of the electric wires (2) stranded together.

[3] The cable (1) as defined in the above [1] or [2], wherein the fiber yarns constituting the cushion layer (5) are composed of rayon yarns (staple fiber yarns).

[4] The cable (1) as defined in any one of the above [1] to [3], wherein an angle formed by the fiber yarns of the cushion layer (5) with respect to a longitudinal direction of the cable (1) is smaller than an angle formed by the metal wires of the braided shield (6) with respect to the longitudinal direction of the cable (1).

[5] The cable (1) as defined in any one of the above [1] to [4], wherein the cushion layer (5) comprises a braid density of not lower than 85 percent.

Although the embodiments of the present invention have been described above, the aforementioned embodiments are not to be construed as limiting the inventions according to the appended claims. Further, it should be noted that not all the combinations of the features described in the embodiments are indispensable to the means for solving the problem of the invention. Further, the present invention can appropriately be modified and implemented without departing from the spirit of the present invention.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A cable, comprising:

a cable core including one or more electric wires;

a braided shield covering a periphery of the cable core and including braided metal wires;

a sheath covering a periphery of the braided shield; and a cushion layer provided between the cable core and the braided shield, the cushion layer comprising a braid including braided linear shape fiber yarns, wherein a braid density of the cushion layer provided to be in contact with the braided shield is higher than a braid density of the braided shield.

2. The cable according to claim 1, wherein the cable core comprises a plurality of the electric wires stranded together.

3. The cable according to claim 1, wherein the fiber yarns constituting the cushion layer are composed of rayon yarns.

4. The cable according to claim 1, wherein an angle formed by the fiber yarns of the cushion layer with respect to a longitudinal direction of the cable is smaller than an angle formed by the metal wires of the braided shield with respect to the longitudinal direction of the cable.

5. The cable according to claim 1, wherein the cushion layer comprises the braid density of not lower than 85 percent.

6. The cable according to claim 1, wherein the braided shield comprises the braid density of not lower than 85 percent, and wherein the cushion layer comprises the braid density of not lower than 90 percent.

7. The cable according to claim 1, wherein the braided shield comprises the braid density of not lower than 85 percent.

8. The cable according to claim 1, wherein the cushion layer comprises the braid density of not lower than 90 percent.

9. A cable, comprising:

a cable core including one or more electric wires;

a braided shield covering a periphery of the cable core and including braided metal wires;

a sheath covering a periphery of the braided shield; and a cushion layer provided between the cable core and the braided shield, the cushion layer comprising a braid including braided linear shape fiber yarns, wherein a braid density of the cushion layer is higher than a braid density of the braided shield.

10. The cable according to claim 9, wherein the cushion layer comprises the braid density of not lower than 85 percent.

11. The cable according to claim 9, wherein the cushion layer comprises the braid density of not lower than 90 percent.

12. The cable according to claim 9, wherein the braided shield comprises the braid density of not lower than 85 percent.

13. The cable according to claim 9, wherein the braided shield comprises the braid density of not lower than 85 percent, and wherein the cushion layer comprises the braid density of not lower than 90 percent.

14. The cable according to claim 9, wherein the cable core comprises a plurality of the electric wires stranded together.

15. The cable according to claim 9, wherein the fiber yarns constituting the cushion layer are composed of rayon yarns.

16. The cable according to claim 9, wherein an angle formed by the fiber yarns of the cushion layer with respect to a longitudinal direction of the cable is smaller than an angle formed by the metal wires of the braided shield with respect to the longitudinal direction of the cable.

* * * * *